US010625834B2

(12) United States Patent
MacFarlane

(10) Patent No.: US 10,625,834 B2
(45) Date of Patent: Apr. 21, 2020

(54) SURFBOARD BOOSTER SYSTEM

(71) Applicant: Alexander T. MacFarlane, Cambridge, MA (US)

(72) Inventor: Alexander T. MacFarlane, Cambridge, MA (US)

( * ) Notice: Subject to any disclaimer, the term of this patent is extended or adjusted under 35 U.S.C. 154(b) by 11 days.

(21) Appl. No.: 15/879,071

(22) Filed: Jan. 24, 2018

(65) Prior Publication Data

US 2018/0208286 A1 Jul. 26, 2018

Related U.S. Application Data

(60) Provisional application No. 62/450,407, filed on Jan. 25, 2017.

(51) Int. Cl.

| | |
|---|---|
| ***B63B 35/79*** | (2006.01) |
| ***B63H 5/07*** | (2006.01) |
| ***B63H 21/22*** | (2006.01) |
| *B63B 35/85* | (2006.01) |
| *B63H 1/24* | (2006.01) |
| *B63H 5/125* | (2006.01) |
| *B63H 21/17* | (2006.01) |

(52) U.S. Cl.

CPC ..... *B63H 5/07* (2013.01); *B63B 35/7926* (2013.01); *B63H 21/22* (2013.01); *B63B 35/7943* (2013.01); *B63B 35/85* (2013.01); *B63H 1/24* (2013.01); *B63H 21/17* (2013.01); *B63H 2005/1258* (2013.01)

(58) Field of Classification Search

CPC ..... B63B 35/7943; B63H 2023/342

See application file for complete search history.

(56) References Cited

U.S. PATENT DOCUMENTS

| | | | | |
|---|---|---|---|---|
| 3,324,822 | A | 6/1967 | Lii | |
| 3,456,613 | A | 7/1969 | Smith | |
| 6,142,840 | A | 11/2000 | Efthymiou | |
| 2003/0167991 | A1 | 9/2003 | Namanny | |
| 2008/0050994 | A1 | 2/2008 | Shibata | |
| 2011/0201238 | A1 | 8/2011 | Rott et al. | |
| 2013/0157526 | A1 | 6/2013 | Martin | |
| 2013/0323989 | A1 | 12/2013 | Derrah | |
| 2016/0347428 | A1 | 12/2016 | Mahar | |
| 2017/0240259 | A1* | 8/2017 | Shaw | B63H 1/24 |
| 2018/0072383 | A1* | 3/2018 | Montague | B63B 1/246 |
| 2018/0170502 | A1* | 6/2018 | Terada | B63H 21/17 |

FOREIGN PATENT DOCUMENTS

| | | |
|---|---|---|
| WO | 2014067563 | 5/2014 |
| WO | 2016034871 | 3/2016 |

* cited by examiner

*Primary Examiner* — Andrew Polay

(74) *Attorney, Agent, or Firm* — Lowe Graham Jones, PLLC; Lawrence D. Graham

(57) ABSTRACT

A motorized fin booster system for surfboard or paddleboard or recreational small craft, consisting of at least one detachable motorized fin and at least one external, contour conforming and waterproof power supply are disclosed. The disclosed system allows for the addition and removal of electrically powered boost to nearly any board without permanent alteration of the board. The system integrates with widely used surfboard components; such as surf fins, leashes, ankle cuffs, and traction pads.

19 Claims, 16 Drawing Sheets

SURFBOARD BOOSTER SYSTEM

PRIORITY CLAIM

This application claims the benefit of U.S. provisional application No. 62/450,407 filed Jan. 25, 2017, the contents of which are incorporated by reference.

BACKGROUND OF THE INVENTION

Beginning with the earliest commercialization of surfboards, various attempts have been made to provide an additional source of thrust to the surfboard or surfer beyond the surfer's own hands and arms. Most surfboards become stable enough to ride in the standing or crouched position (as opposed to prone or kneeling) once they reach planing speeds. Planing speeds are achieved when the surfboard exceeds the "hull speed" established by a bow wave as related to the length and displacement of the craft. The bow wave itself is a sort of speed barrier for any watercraft, where the bow wave acts as a "hill" requiring significant thrust to overcome. Meanwhile, the minimum speed of a rideable wave is around 5 m/s or 10 mph, which exceeds the maximum non-planing hull speed for a surfboard less than ~3 m in length. Therefore, planing speeds are required to catch most waves on most boards.

To achieve planing speeds, break free of the surfboard's bow wave, and "catch" a wave, additional acceleration is required by the surfer. This acceleration is normally acquired by sliding down the face of a wave using gravity. Typically, only breaking or near-breaking waves offer sufficient downward angle and height for the surfer to achieve sufficient acceleration down the wave face to exceed hull speed of the board and begin planing. On small (slow) waves and large boards with greater hull speeds, catching a wave and achieving planing speeds can be relatively easy for a beginning surfer. However, it may be difficult for the surfer to position himself at the correct location in the breaking or near-breaking wave to achieve sufficient acceleration in waves much over 1 m. To both navigate to the right location and to provide the initial thrust necessary to enter the wave itself, the surfer must use his own muscle power. Further, there are a limited number of "breaks" at a given surfing location where the downward slope of the wave is sufficient to catch the wave. As wave height, and therefore speed, increase, the acceleration required to catch the wave also increases, further decreasing the size of suitable breaks. The result is often over-crowding at the best breaks, and an extreme physical effort required to position oneself at the best break and catch the wave. Only a limited number of waves typically break correctly, leading to most time spent by the surfer simply waiting for the right wave. Indeed, most time spent by a surfer is paddling and waiting, relatively little is spent riding the board.

If planing speeds could be achieved more easily, for example, on waves that were not yet breaking (less steep), there would be more waves at a given surfing location appropriate for surfing. Further, surfing fatigue associated with positioning and entering a wave could be reduced, thereby extending the time allowed for surfing. Also, less waiting would be required, making each surf session more enjoyable. Therefore, a means to increase thrust beyond maximum human power for surfboards and other wave-riding aquatic craft is desirable.

Previous attempts to add thrust beyond human power to a surfboard are largely focused around adding all of the required elements, including: 1) propeller or jet drive 2) motor, 3) energy storage, 4) motor control/switching system, and 5) user interface, to the surfboard body itself, thus resulting in a specialized surfboard, such as described in U.S. Pat. Nos. 6,142,840 and 3,324,822. There have also been attempts to modify a surfboard fin to include the required elements 1-4 above, in which the user interface is a remote control, and the surfboard is not therefore modified other than the fin itself, such as in U.S. patent publication 2003/0167991). In addition, there are a few designs in which the elements are separated, for example, where the energy storage and switching are attached to the surfboard and connected to a specialized surfboard thruster containing the propeller and motor.

Combinations of the various elements required to add thrust to a wave-riding craft suffer from a range of problems, making current designs impractical and unattractive to the average surfer. Firstly, a motorized board (the predominant type) is impractical for wave surfing for the following reasons. Surfers prefer changing board types for given wave conditions. While a motorized board could provide more ability for a fixed board type to work in different conditions, the average surfer is not likely to settle with just one board type. Also, when travelling to a surfing destination, the surfer may not prefer to bring the entire board. Secondly, every surfboard is designed to be represent some ideal combination of lightness (minimum displacement), strength, cost and shape. Adding motor, batteries and electronics to the board increases displacement, decreases board structural strength, increases cost and restricts possible shapes—all negative factors for the surfer. In particular, enclosing the electronics and batteries, or engine and fuel from the marine environment is very difficult and should it fail, the entire board is ruined. Boards can also break against reefs or beaches, and a large investment in a motorized board could easily be totally ruined in this manner as well. In most cases, motorized surfboards are best suited for use outside the breaking wave area.

One solution to the problems associated with the motorized surfboard is to place all or nearly all required elements into the fin, or another submerged thruster, which can then be detached from the board. This allows the surfer to provide additional motive thrust to any board he chooses. Unfortunately, the surfboard fin is typically far too small to contain all required elements, especially sufficient energy storage in the case of batteries. Any battery capable of fitting inside a surfboard fin today can only offer very little ride time. While devices exist where the power supply is external to the detachable thruster, such battery packs are bulky and located on the surfboard deck in a hard case, which will affect surfboard ride and utility. Further, while the surfer is paddling in the prone position, a hard case battery storage located anywhere on the surfboard deck will interfere with paddling and surfer comfort. This approach is limited to, for example, stand-up-paddleboards or kayaks where the user is not prone on the deck at any time.

While external power supply is preferred, any such external power supply should minimally interfere with the surfing activity. In accordance with aspects of various embodiments of the invention as described below, a power supply if worn by a user should conform to the contours of the user's body at the points of contact, preferably in a manner similar to a wetsuit, neoprene ankle strap, watch band, or padding of a camping backpack. If the power supply is attached to a board, it would preferably offer the lowest profile and displacement possible by matching the complex contours of the board's surface, which vary from board to board; in a similar manner to, for example, a sticker applied to a car windshield or foam rubber traction pads adhered to surfboards. In either the user-worn or board-attached cases, fundamentally rigid elements (batteries and electronics modules) must conform to the contours of the user or board. This conformance must take place through repeated attachment and detachment cycles. Further, such a power supply should be inherently waterproof and preferably sufficiently buoyant to remain floating if it becomes accidentally detached. Such a power supply should be easily and securely attached and detached from either the user or the board, for example using hook-and-loop straps, adhesives or suction cups.

As described earlier, a motorized thruster is only required to provide additional thrust during the initial phase of positioning and catching the wave. After this point, the motor is largely unnecessary and board performance is all-important. A motorized surfboard containing all required elements will inevitably sacrifice wave-riding performance due to increased weight when the motor is not operating (most of the riding time). And any surfboard design in which the propeller is located external to the board itself (e.g. not an inboard jet) will cause significant drag whilst not operating which will seriously negatively affect riding performance.

Surfing is a near-shore sport and shorelines accumulate free floating aquatic weeds and debris. These can easily foul a non-operating propeller or jet intake on an operating jet and utterly ruin the performance of both the surfboard and the motorized thruster.

The ideal system for adding thrust to a surfboard or other wave-riding craft would therefore offer a boost to the surfer when needed and essentially disappear when not needed, would conform to the contours of the board or user, and would also be easily detached and re-attached to any surfboard or wave-riding craft.

SUMMARY OF THE INVENTION

The disclosed invention is a surfboard booster system containing the primary elements of a detachable motorized fin, and external power supply and a user-operated trigger. The detachable motorized fin is preferably suitable for use in conventional fin anchorages (fin boxes) such that it may be used in a wide variety of surfboards.

The detachable motorized surfboard fin may preferably include a high-power motor and gearhead, and may be optimized for heat exchange with the surrounding water.

The preferred embodiments of the detachable motorized fin include a folding propeller that folds away (preferably automatically) when not in use to minimize drag and prop-fouling potential. The folding propeller hub preferably includes a landing post upon which the folding blades my rest when folded.

The external power supply is preferably "conformal" or contour-conforming to either the user or the board and may preferably be worn as an ankle cuff, attached to the board as a traction pad or strapped to the board. A wide variety of configurations for the conformal power supply are anticipated. In all preferred configurations, electronics modules and batteries encased within the power supplies are protected from water ingress and structural deformation by their surrounding enclosures. These enclosures may contain flexible or resiliently compressible materials of construction that a) allow the rigid electronics and battery elements to articulate with respect to one another, or b) compressibly conform or c) both articulate and compressibly conform against the contacting surfaces of the surfboard or the user's body such that the power supply is therefore contour-conforming.

In the case where the conformal power supply is attached to the board, this attachment is preferably temporary; where the use of straps, suction cups or adhesives may allow its detachment from the surfboard.

In the case where the power supply is worn by the user, power may preferably be exchanged between the power supply and the motorized fin via a modified leg-strap or "leash" that, in one example, remains sufficiently light, elongating and capable of swiveling.

The booster system is energized by a user-worn trigger that allows the user to depress the button and continue paddling. The disclosed booster system is designed to integrate with the sport of surfing to the greatest extent possible and should offer the user a significantly enhanced experience.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
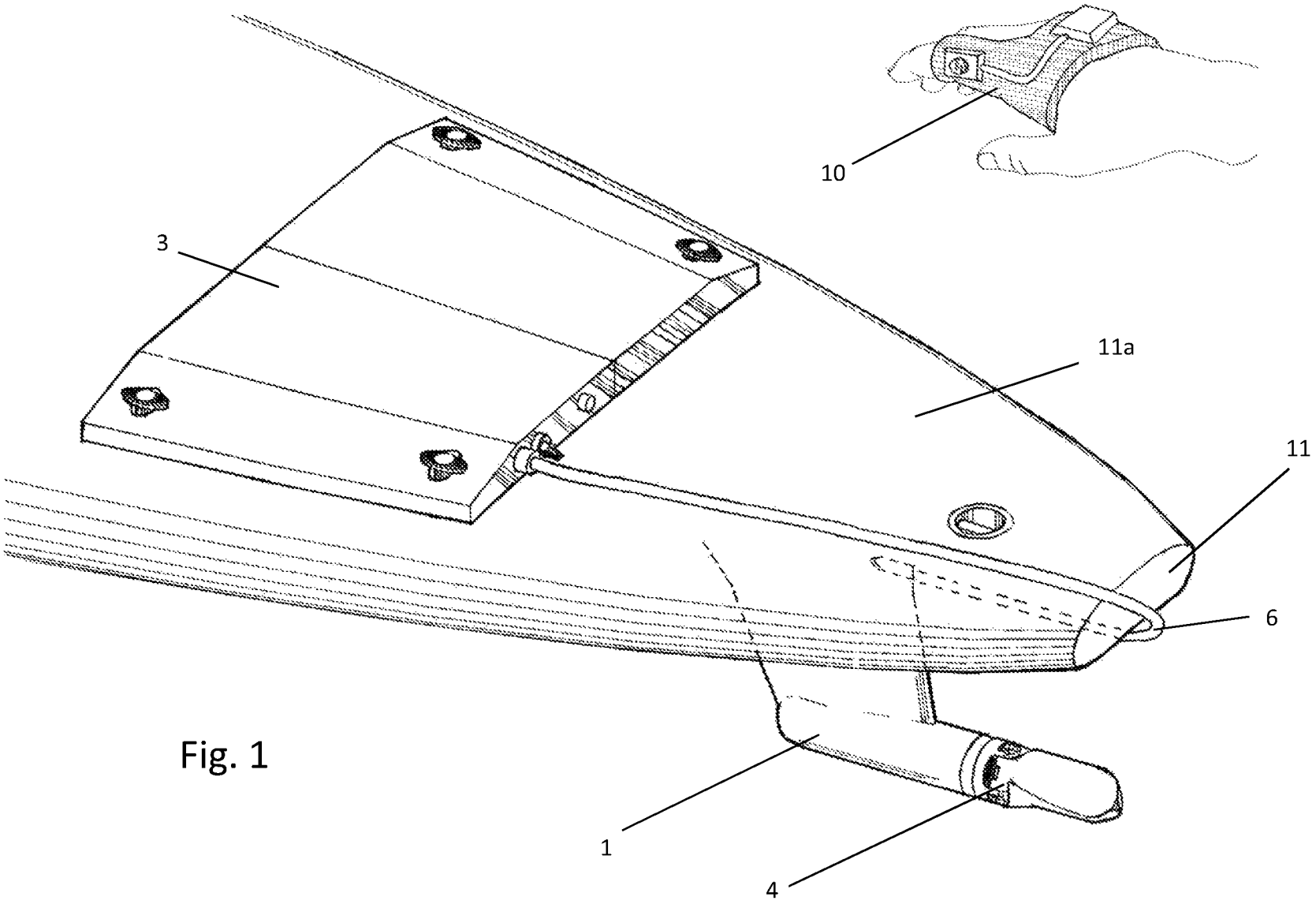
FIG. 1 shows a top perspective view of a preferred embodiment of the surfboard booster system, including a conformal or contour-conforming waterproof power supply, detachable motorized fin and user-worn trigger, shown on an cutaway portion of a board.

FIG. 1 shows the primary elements of the surfboard booster system, as attached to a surfboard illustrated in partial cutaway view. A detachable motorized fin 1 (further described in FIGS. 4 and 6), boosts the forward movement of a surfboard 11, which may be any surfboard with provision for standard detachable surfboard fins (attachment mechanisms further described in FIGS. 2 and 3). The fin 1 turns a propeller 4, and in the illustrated example the propeller includes folding blades (further described in FIG. 5) which open and provide forward thrust to the surfboard 11 via a mechanical attachment between the fin 1 and the surfboard 11.

The motor in the fin 1 is an electric motor and is powered by an external power supply. In the example as illustrated in FIG. 1, the power supply is a board-mounted battery pack (further described in FIG. 12), and as shown it is mounted to the upper surface 11*a* of the board. Power is supplied to the motorized fin 1 via a conductor 6 which is illustrated as a cable or wire.

In the preferred embodiment, as illustrated in FIG. 1, a remote trigger 10 (further described in FIG. 14) is used to allow power to flow from the power supply 3 to the motorized fin 1, controlling the operation of the fin by turning it on or off. In the preferred embodiment, the remote trigger is worn by the user as shown in FIG. 1 in which the trigger 10 is incorporated into a sleeve or strap attached to a user's hand.

Each of the primary elements shown in FIG. 1, as well as several alternatives and their associated elements is described in further detail in subsequent Figures.

Figure 2:
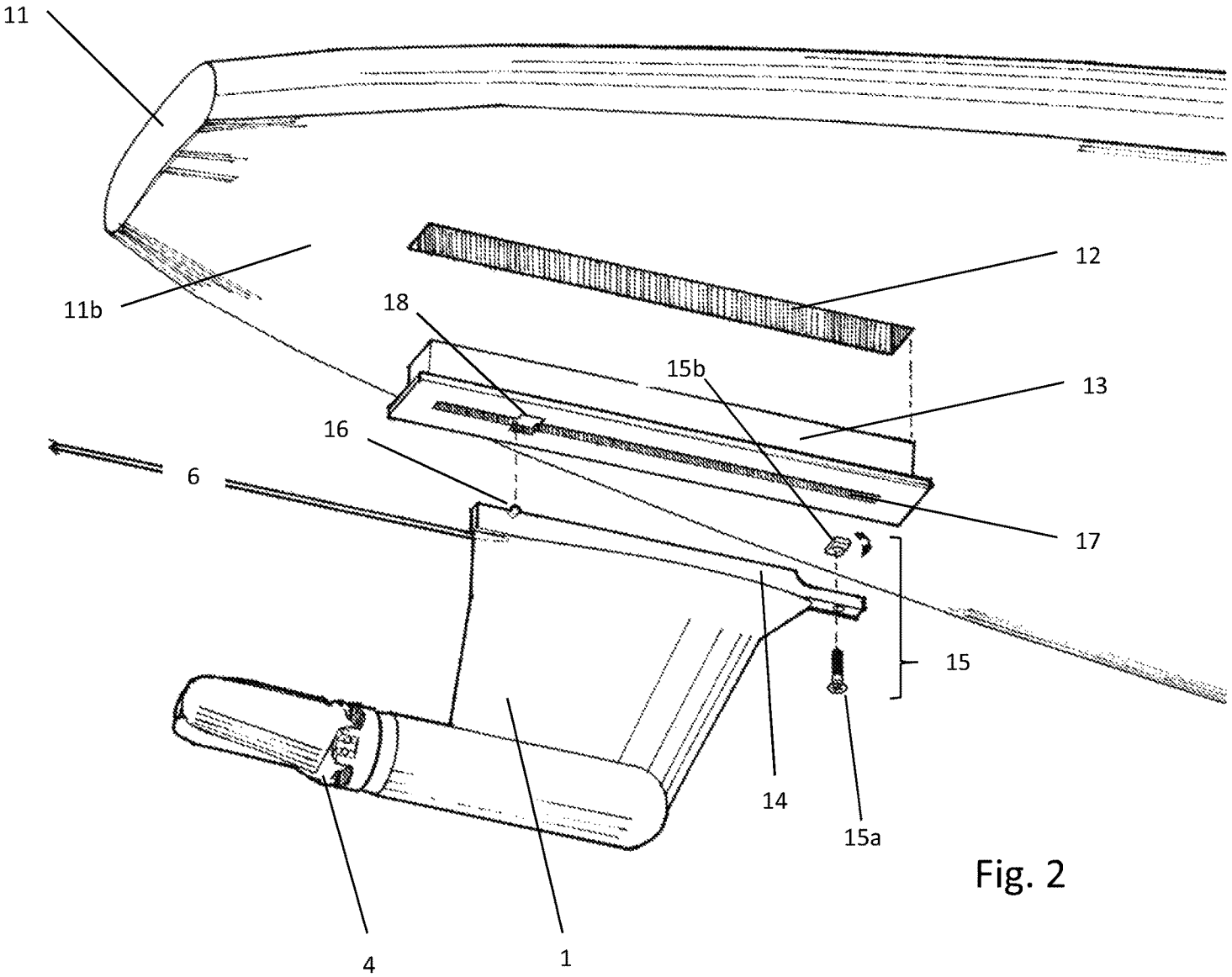
FIG. 2 is a bottom perspective partial exploded view of the detachable motorized fin and its means of anchorage in surfboard using conventional attachment mechanisms.

FIG. 2 shows one configuration for attaching the detachable motorized fin 1 to a conventional surfboard 11. The typical surfboard construction consists of a foam core blank wrapped in hardened fiberglass or epoxies.

Elements such as the fin anchorage 13 (commonly known as a fin box) may be permanently installed in the lower side 11*b* of the surfboard 11 by excavating a cavity 12 through the outer layers and into the interior of the surfboard.

The cavity 12 may be sized for the anchorage 13 to fit snugly such that the outer-facing surface of said anchorage 13 may be flush with the bottom finished surface 11*b* of the surfboard 11. In the illustrated example, the cavity 12 is a rectangular cubic shape and the anchorage 13 includes a base portion having a complementary shape to fit within the cavity. An outer flange on the anchorage 13 is preferably included and has a rectangular perimeter which is larger than the perimeter of the cavity.

Epoxy resin and sometimes additional fiberglass may be used to secure the anchorage 13 into the cavity 12 and the resulting bond should be very secure and permanent. Many forms of such anchorages exist, and the motorized fin described here may be suitable for any such anchorage.

As shown in FIG. 2, the motorized fin may have a male attachment consisting of a surfboard fin attachment element 14, which is sized to fit within the anchorage receiver opening 17. In the illustrated example, the anchorage receiver opening is configured as an elongated slot extending substantially along the entire length of the anchorage 13. Likewise, the attachment element 14 is preferably configured as a narrow elongated rib sized and configured to fit within the slot.

In addition, a fin attachment pin 16 and/or a fin attachment fastening 15 may be used to secure the fin into the anchorage. Various types of fastenings and pins may be used for the various types of anchorages. As illustrated, the pin 16 may be sized to be received within an enlarged lateral opening 18 provided in the elongated slot. The pin 16 may be positioned slightly closer to the rearward end of the rib than the opening 18 is positioned with respect to the rearward end of the slot 17. Accordingly, the pin can be inserted into the slot and then the rib can be slid rearward. The pin is then retained within the slot because the width of the pin is greater than the width of the slot opening (other than at the enlarged lateral opening 18).

The fin attachment fastening is illustrated as a combination of a screw or bolt 15*a* and a threaded nut or other threaded receiving element 15*b*. The threaded receiving element may be inserted through the enlarged lateral opening and then slid forwardly into position, or may be permanently installed in a desired location within the anchorage.

The attachment element 14 alternatively may take the form of an adapter to allow the disclosed motorized fin to be used with other types of anchorages via different adapters. Furthermore, the surfboard fin attachment element 14 itself may take a variety of shapes to suit the available anchorages. Most preferably, however, it is removably attachable, as is the case in the illustrated example.

A non-rotating conductor 6 as shown may or may not be incorporated into the fin anchorage as shown, however, that should not preclude the use of fin boxes or other permanent attachments to allow such non-rotating conductors to penetrate the surfboard 11 from the upper to lower side, either on a temporary basis or permanently.

Figure 3:
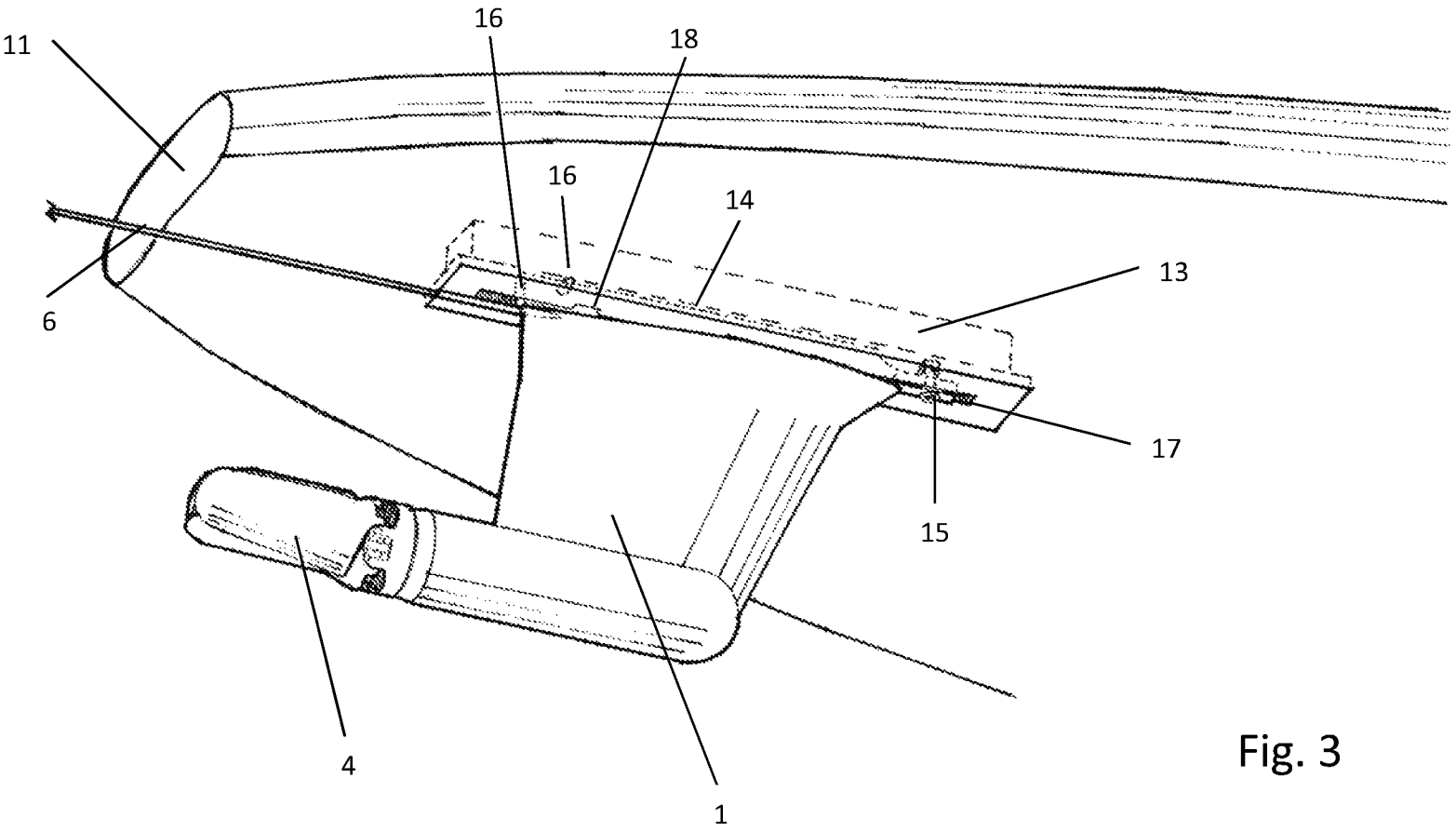
FIG. 3 is a bottom perspective view of the detachable motorized fin installed in a surfboard.

FIG. 3 shows a view of the underside of the surfboard 11 as with FIG. 2, but in this case with the detachable motorized fin 1 installed. In this illustration, the pin 16 is shown positioned rearward of the enlarged lateral opening 18, and trapped within the slot 17. The fastener 15 is also shown, mounting the fin to the anchorage.

The motorized fin 1 may serve the same function as a conventional surfboard fin installed in a conventional fin anchorage, such as permanent anchorage 13. Specifically, it may resist side slipping of the surfboard in the water, and allows the surfer to willfully direct the board against the face of the wave. Just like an airplane wing, the fin must provide tangential lift while avoiding the creation of resistance to forward movement, or drag. Therefore, the motorized fin should present the smallest possible cross-section to water flowing from forward to aft and from side to side. For this reason, the preferred embodiment of the propeller 4 may use folding propeller blades that are streamlined with respect to both forward movement and side to side movement of water.

As shown in FIG. 3, the propeller blades are folded and are largely cylindrical (or fit within a cylindrical space) in the folded position. There are a minimum of protruding surfaces, and drag and fouling potential are minimized. When not operating (that is, when the blades are folded or retracted as in FIG. 3, and therefore not spinning), the detachable motorized fin should offer minimal change to board performance relative to a conventional surf fin.

Figure 4:
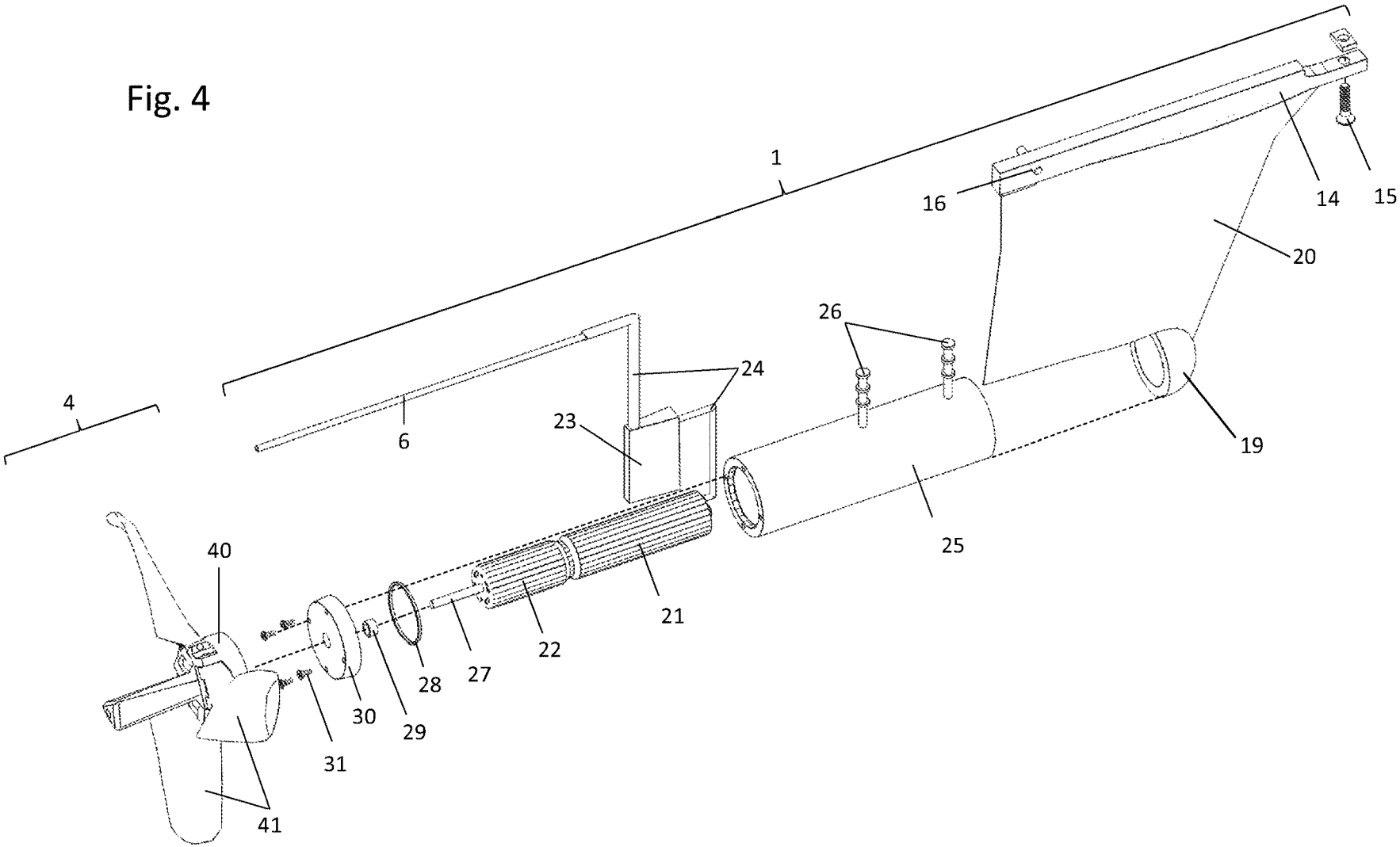
FIG. 4 is an exploded view of the motorized fin with motor housing separate from the exterior canister of the motor.

FIG. 4 is an exploded view of the detachable motorized surf fin with the preferred folding propeller in the open or deployed position so that that the blades are extended rather than retracted.

The motorized fin body 20 may be very similar in outward appearance to a conventional surf fin in the illustrated version and, like a conventional fin, may be attached and removed from a surfboard by any available attachment and removal method available to conventional surfboard fins.

The surf fin body 20 may further be constructed in a similar manner to conventional fins, for example, by injection molded plastic, or may use more sophisticated construction methods such as composite lamination.

In the embodiment shown in FIG. 4, the fin body 20 may include the fin attachment element 14 and a rounded cowling 19 to reduce drag by the motor housing 25. In addition, fin motor housing 25 may be attached to fin body 20, via motor housing mechanical anchorage points 26. In one version as illustrated, the fin motor housing is cylindrical in shape, with the central axis extending substantially parallel to the long axis of the board.

The motor housing 25 contains an electric motor 21 and optional gearhead 26 to reduce speed and increase torque to the propeller 4. The gearhead may be directly attached and integral to the electric motor as shown or may be a separate unit. The housing 25 may also include a variety of seals to exclude seawater from the internal working parts contained within said housing, the seals being optionally integral to housing cover 30. For example, O-ring motor housing seal 28 may seal the motor housing 25 to motor housing cover 30, while shaft seal 28 may surround and seal output shaft 29 against shaft penetration in housing cover 30.

Alternatively, the entire drive assembly may be hermetically sealed from the environment and transmit rotary motion via magnetic couplings through containment barriers (not shown). In addition, dielectric fluid such as mineral oil may fill the cavity & gaps between the motor 21 and optional gearhead 22 and motor housing 25 to protect, lubricate and provide heat removal functions.

Alternatively, the electric motor 21 may not be sealed from the seawater and rather the internal parts such as windings and magnets may be provided with a seawater-resistant coating, for example epoxy. In this case, seawater itself provides cooling to the windings directly. In either case a direct coupling or magnetic coupling may connect the output shaft of the motor 21 to the input shaft of the gearhead 22. The electric motor 21 and its optional gearhead 22 may be totally isolated from seawater via hermetic seal, largely isolated via optional end-cap 30, shaft seal 29, housing seal 28 and/or stuffing boxes or, optionally, not isolated.

FIG. 4 also shows a power control module 23 internal to the fin body 20, in which the module is entirely isolated from seawater and sealed. The power control module 23 may be located internal to the fin body 20 as described here, or may be located as part of the external power supply, or may not be included in the overall booster system at all.

The power control module 23 serves to receive power and optionally, data signals, provided by the power supply and associated switching and receiving modules via electrical conductors 6, convert the power into speed-regulated pulses timed to the motor 21 requirements via fin integral conductors 24, and receive data from the motor's 21 sensors if needed.

The power control module 23 may also incorporate other motor control functions, for example a soft start integrated circuit which ramps the speed of the motor up gently to avoid mechanical shock to the drivetrain and/or high inrush current to the electrical system. The power control module is also commonly known as an electronic speed controller.

The detachable motorized fin 1 may also include the switching module and/or receiving module, and the electronics modules may even be integrated into a single module such as power conditioning module 23. These possible arrangements of electronics modules are further described with reference to FIGS. 15 and 16.

Figure 5:
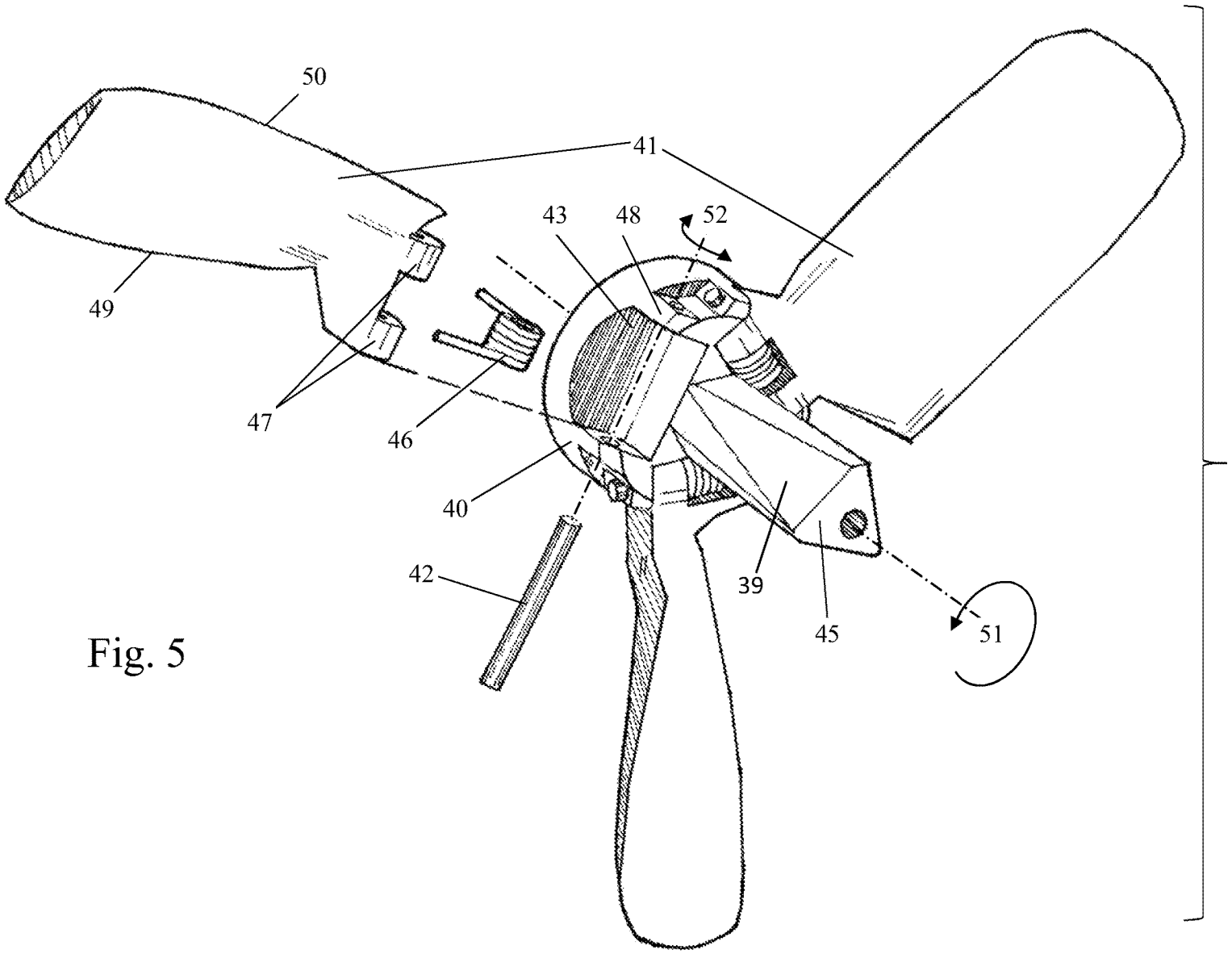
FIG. 5 is a partially exploded rear view of the folding propeller, with propeller blades in the open position.

FIG. 4 shows a propeller 4 with propeller blades 41 in the open position, which is the means of converting mechanical rotary motion of the driveshaft into forward thrust. FIG. 5 is a partially exploded view of the entire propeller group 4 where propeller blades 41 are open in the operating position. A rotor hub 40 establishes the connecting point between the rotating output shaft 27 (FIG. 4) to the folding propeller blades 41. The propeller rotates along the axis of propeller rotation 51, in a direction such that blade leading edge 49 is the leading edge and trailing edge 50 is the trailing edge. Operation in reverse may not be necessary for the successful operation of the disclosed surfboard booster system.

The rotor hub 40 may extend for approximately the entire length of the folded propeller blades, as is the case in the illustrated version, to form a landing post 45 for the propeller blades when folded. In the illustrated example, the landing post includes a plurality of beveled faces, e.g., 39, to provide an abutment surface for the corresponding blades.

Typical folding propeller blades do not include such long rotor hubs and the blades commonly "feather" or fold into one another when not in use. These typical folded or feathered blades then trail behind or perpendicular to the drive shaft, and while presenting much less drag than a fixed blade, non-folding propeller, said folded blades still offer a source of drag and weed fouling potential. The connection between the housing and rotor in propeller 4 is therefore smooth and presents minimal disturbance to flowing water when folded and therefore minimizes drag. As these conventional folded propeller blades are unsupported they are more likely to be damaged by impact with a beach or reef. Further, a surf fin is exposed to significant side to side water flow in addition to forward movement, so conventional folding propeller blades may be dislodged from their folded position by such side to side flow.

In the folding propeller design of the preferred embodiment, the propeller blades may fold into a nesting pattern on the rotor hub and may contact with and rest against and be supported by the landing post 45, such that when said propeller is not operating and blades 41 are in the folded position (as in FIGS. 1, 2, 3, and 9) the blades may appear as if an integral part of the rotor hub, and by extension the motor housing and the motorized fin as well.

Propeller blades 41 may be connected to the rotor hub 40 by propeller blade hinge mechanisms. The hinges are preferably simple in design, for example, conventional knuckle and pin hinges, where the blade knuckle(s) 47 may be integral to the propeller blades and retained to rotor knuckles 48 with a friction-fit hinge pin 42.

In the illustrated example, there is no additional mechanism necessary to open the propeller blades 41. To open propeller blades 41, the shaft begins rotation, thereby providing centrifugal force to the blades to open, and the propeller blades are fully forced into the open position by forward lift generated by the blades themselves. Further, the leading edges 49 of the blades 41 may catch water in the folded position once they begin rotation, giving further lift force to initiate opening.

Once the blades 41 stop spinning, when power to the shaft is removed and centrifugal force as well as forward lift pushing blades forward ceases, the continuing forward motion of the craft through the water may cause the blades to fold back once again against the hub 40 and its landing post 45. In addition, the propeller 4 may also include a method of retaining the stowed propeller blades 41 against the landing post 45, for example torsion springs 46, which provide a twisting force against the propellers about their hinge pins 42, such that the twisting force along the axis of propeller blade folding 52 is excessively counteracted along the same axis 52 by the aforementioned centrifugal and lift forces generated by rotation of the propeller, allowing the propeller blades 41 to open when propeller 4 is rotating during operation.

A hinge pocket 43 provides sufficient volume for the hinge pin 42, propeller blade knuckle 47 and torsion spring 46 to nest within the rotor hub 40 such that there may be minimal protrusions from the entire propeller 4.

Figure 6:
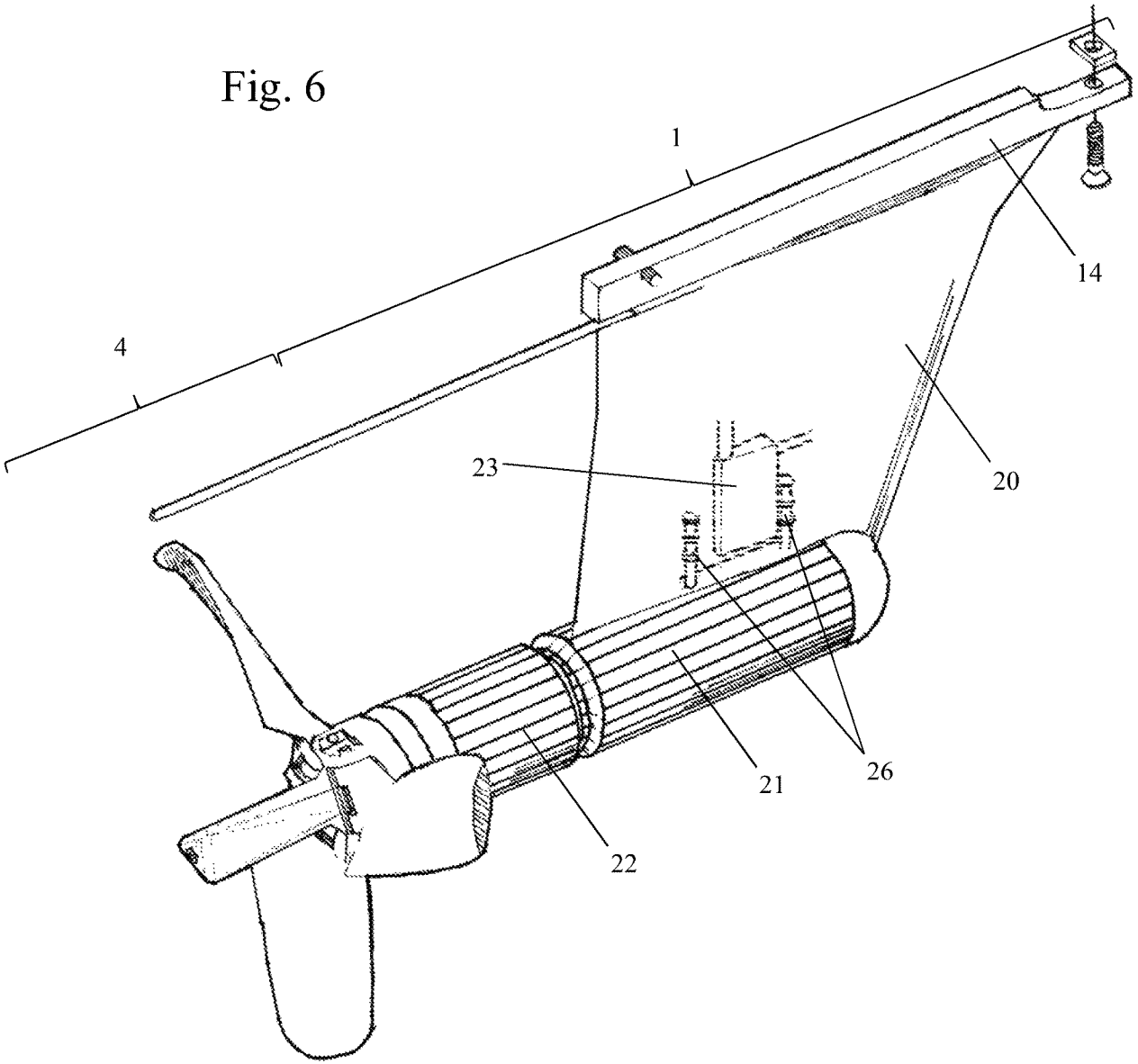
FIG. 6 is a projection view of the motorized fin and open propeller, where portions of the motor and gearhead's exterior canister surface(s) form the motor housing.

FIG. 6 is a parallel projection view of the detachable motorized surf fin 1 with the preferred embodied folding propeller 4 in the open position. In the motorized fin embodiment shown in FIG. 6, as different from that shown in FIG. 4, portions of the exterior surfaces of the motor 21 and optional gearhead 22 may form the outer motor housing and may be directly in contact with the surrounding water. This configuration may allow more direct exchange of heat from within the motor and gearhead to the surrounding water, which may increase motor and gearhead efficiency by more quickly removing excess heat from within. Many of the same or similar sealing elements discussed in FIG. 4 may apply in FIG. 6 to ensure a sealed interior for the motor and gearhead.

Further, in the version of FIG. 6, as above, the motor 21 and gearhead 22 may have the majority of their interior volumes filled with dielectric fluid to assist with lubrication and thermal management.

Rather than mechanical attachments 26 between the fin body 20 and a separate motor housing (as in FIG. 4), the embodiment shown in FIG. 6 may include motor housing mechanical attachments 26 that connect directly to the exterior surface of the motor 21 and or gearhead 22, with the exterior surfaces forming the motor housing in this case.

Other elements such as the fin attachment mechanism 14, propeller 4, power control module 23 and other elements not shown in FIG. 6 may be the same or similar as for the fin booster system components shown in other Figures.

Figure 7:
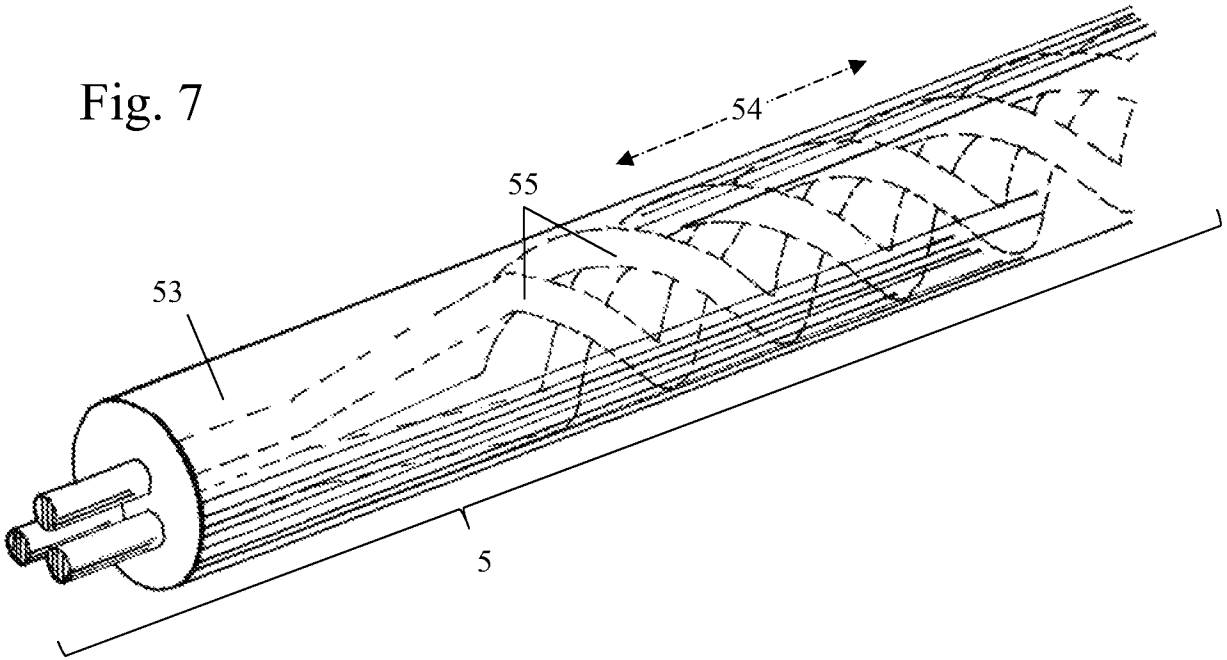
FIG. 7 is a perspective view showing a portion of an exemplary electrically conductive leash cord with integral conductors, including arrows indicating the axis of elongation.

FIG. 7 illustrates a portion of an exemplary leash cord with integral elongating conductors, including arrows 54 indicating the axis of elongation. The leash cord 5 consists of elongating electrical conductors 55 internal to the leash cord 5 and electrically isolated from each other and the surrounding environment by leash cord material 53, and optionally individual wire insulation. The leash cord material 53 is for example, conventional high strength flexible urethane as used in most surf leash cords.

To allow linear extension and contraction of the leash cord in the event of forceful elongation by an errant surfboard, the conductors internal to the leash cord may be provided with more conductor length than absolutely required when the leash cord is in a non-elongated condition. In this way, the conductors can elongate and contract along with the leash cord material.

In FIG. 7, this excess conductor length is represented as a spiraling form of conductors 55 within the leash cord material 53. However, the leash cord material may be separate from the conductors, and the conductors may be freely disposed within the core of the leash cord. For example, the leash cord may be a urethane hose with conductors 55 as insulated wires located within.

Further, the electrical conductors 55 may be wrapped outside of leash core material 53 and be protected from the marine environment via another form of insulation. The conductors 55 within the leash cord 5 form the electrical connection between the batteries and the motorized fin, while the leash cord 5 itself forms the mechanical connection between the surfer and the surfboard.

Figure 8:
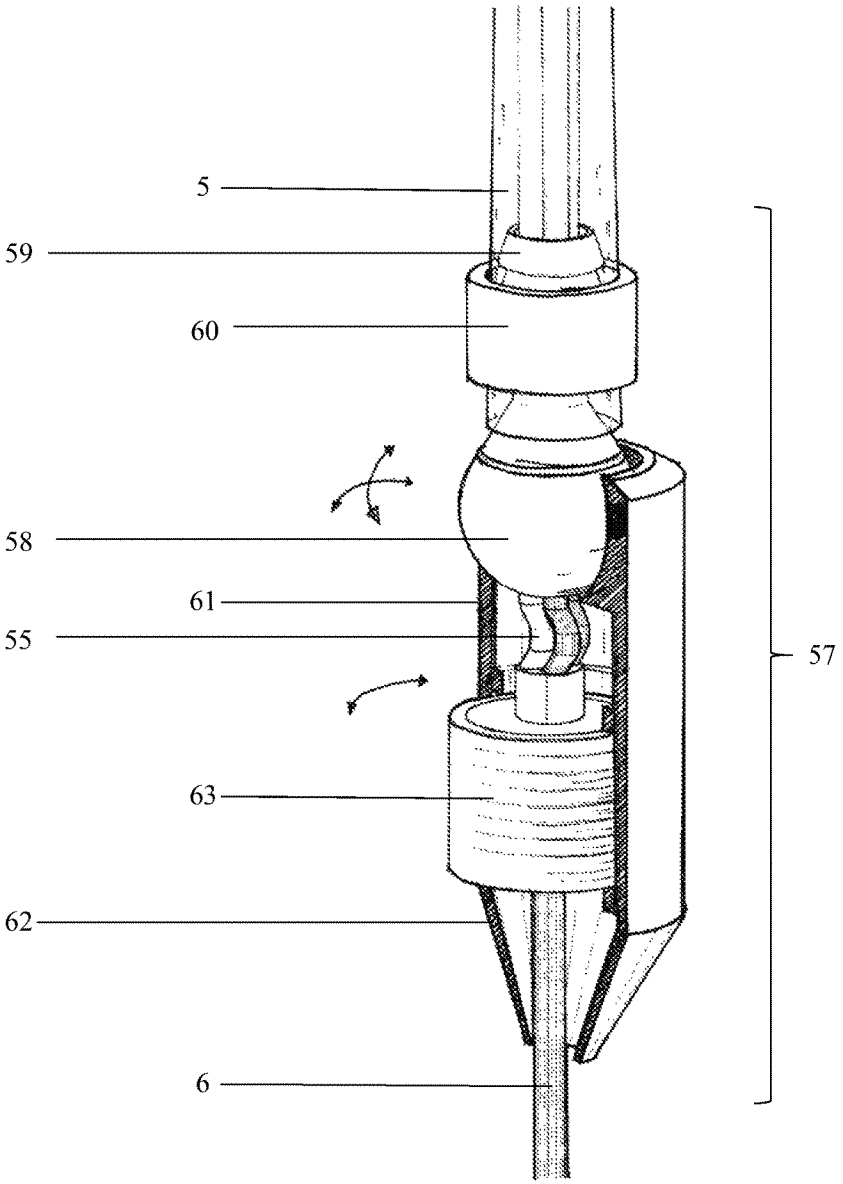
FIG. 8 shows a partial cutaway view of a leash swivel, by which the leash can freely rotate while maintaining mechanical and electrical connection between the user and the surfboard.

FIG. 8 is a partial cutaway view of a leash swivel fitting 57, by which the leash 5 can freely rotate while maintaining mechanical and electrical connection between the user-worn power supply and the surfboard and detachable motorized fin 1 through the leash. The fitting may provide both mechanical and electrical connection between the ankle cuff and the leash, and mechanical connection between the leash and the surfboard, and electrical connection between the leash and the motorized surfboard fin. Full 360-degree rotation is allowed by this fitting which may avoid potential for disruptive tangling and twisting of the leash cord or electrical wiring.

Starting first with the mechanical connection at the leash cord 5, the rotating leash cord 5 is firmly attached to a rotating leash mechanical anchorage 58 which may include a leash to swivel mechanical attachment 59 forced within the leash cord and secured additionally at the exterior by a crimp fitting 60 or similar clamping means. A rotating leash mechanical anchorage 58 is secured within a non-rotating swivel fitting housing 61. The housing 61 is then secured to the ankle cuff or surfboard attachment point via a mechanical attachment attached to either the housing 61 or housing end cap 62. This is shown in FIG. 9 as a ring through the housing end cap 62, but may take any suitable form that allows movement of the leash cord while providing secure connection against the forces that can develop from an errant surfboard.

Now in consideration of the electrical connection through the swivel fitting 57, and starting with the leash cord, the elongating conductors 55 internal to the leash cord emerge from within the body of the rotating leash anchorage 58 and are connected permanently to an electrical slip ring 63 located within the swivel fitting housing 61. The slip ring allows 360-degree rotation of the electrical contact between the incoming elongating conductors 51 and outgoing non-elongating conductors 6.

The interior of the swivel fitting is isolated from the surrounding water by contact between the rotating leash mechanical anchorage and the non-rotating swivel fitting housing, and optionally, a seal between the surfaces in contact between these two parts. The interior of the swivel fitting may also be isolated from the surrounding water by a permanent seal between non-elongating conductors 6 and the housing 61 and/or housing end cap 62, where said seal may comprise a sealant filling. In this way, the swivel fitting allows full rotation of the ingoing and outgoing electrical conductors relative to one another as well as the mechanical connections at the board and ankle cuff relative to the leash cord. While FIG. 8 shows the electrical and mechanical swivel as one assembly, nothing in the previous description should forgo these elements to be physically separate from one another or omitted entirely, or in part, from the system.

Figure 9:
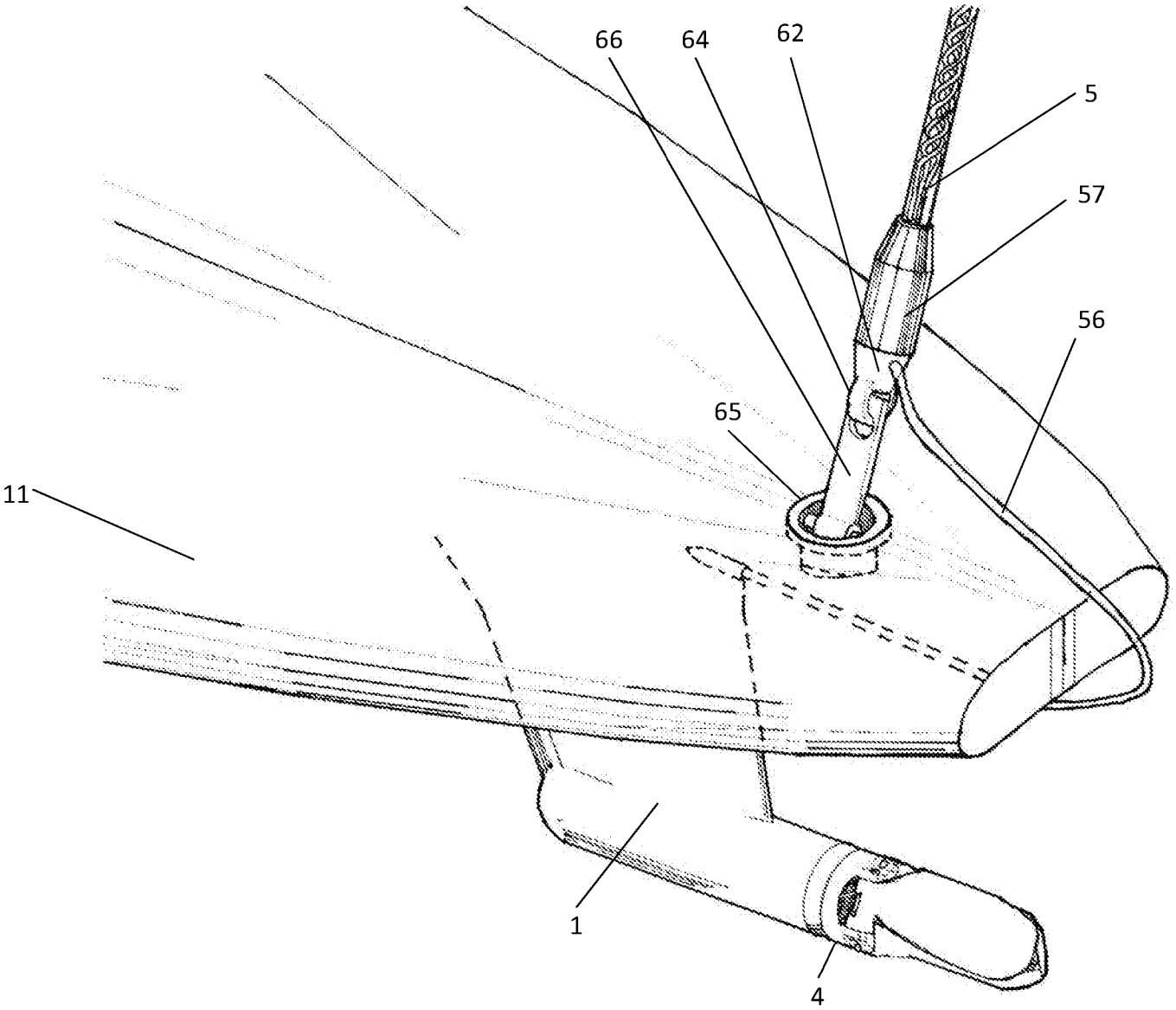
FIG. 9 is a top perspective view illustrating the mechanical and electrical connections between the electrically conductive surf leash cord and the surfboard and the detachable motorized fin, respectively.

FIG. 9 shows a configuration of the surfboard fin booster system in which the electrically conducting leash cord 5 is used, for example, when the conformal power supply is a user-worn ankle cuff battery back. A permanently installed leash cup 65 installed within the surfboard 11, for example by epoxy resin allows a conventional leash strap 66 to secure leash swivel fitting 57 via a ring 64 installed through non-rotating housing end cap 62. Non-elongating conductors 56 emerge from the swivel fitting 57 and make the electrical connection between the power supply and the detachable motorized fin 1.

Figure 10:
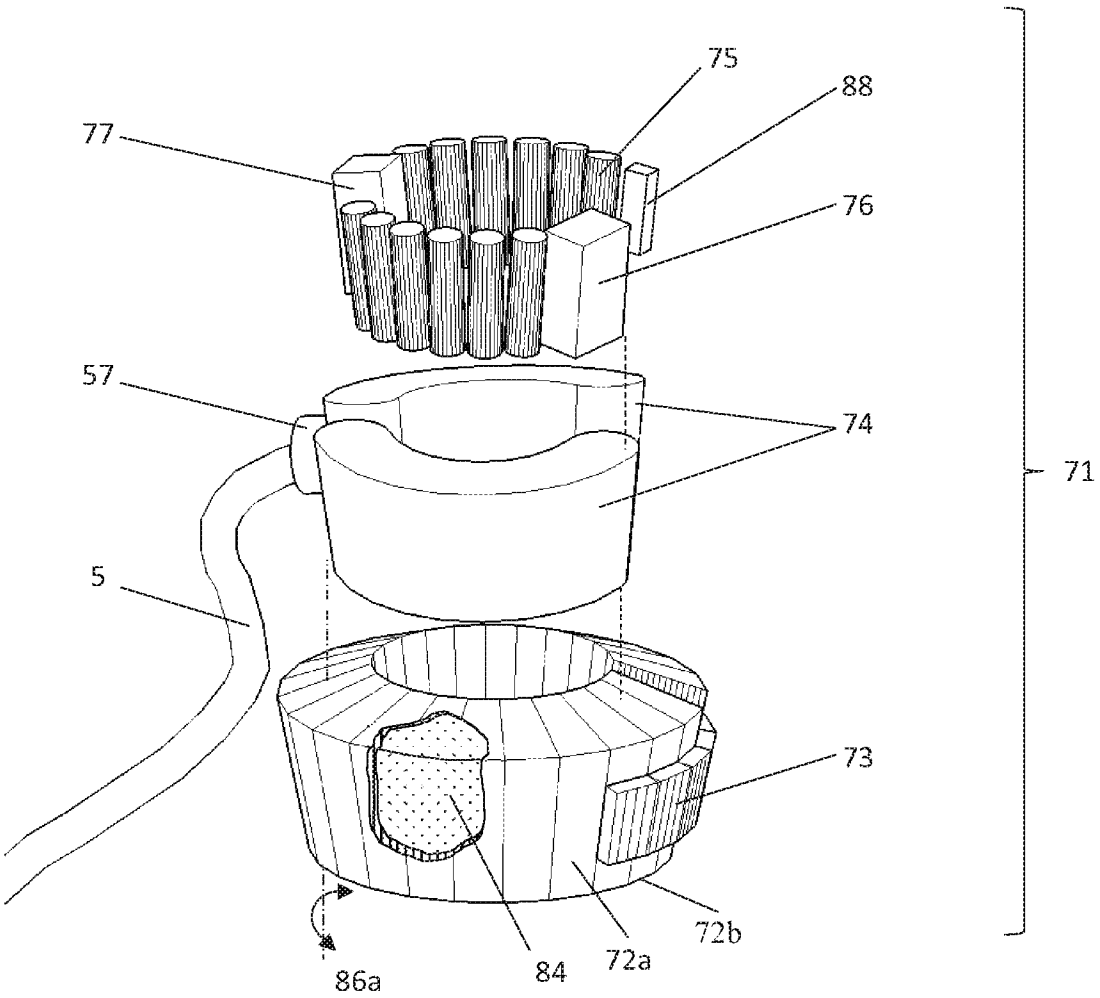
FIG. 10 shows an exploded perspective view of a user-worn external and waterproof contour-conforming power supply in which the power supply is a leash cuff.

FIG. 10 shows an exploded perspective view of the user-worn power supply, which is a leash cuff 71 (preferably an ankle cuff) containing batteries, switching controls and leash connection. The cuff is, in outward appearance, similar to a conventional surfing ankle cuff, the purpose of which is to establish a physical connection point at the ankle or lower leg between the surfer and the surfboard via a flexible "leash" or "leg rope". The conventional surfing ankle cuff conforms to the contours of the user's ankle for a close comfortable fit while offering a sufficiently strong attachment point for the leash. This is typically accomplished by a construction using strong and contour-conforming materials, for example resiliently compressible neoprene rubber and strong, flexible nylon webbing, alone or in combination. The outer cuff may also be formed from a series of wedge-shaped sections, e.g., 72*a*, 72*b*, formed from materials such as discussed above and below, and joined together to enable articulation and/or expansion and contraction or compression of the cuff. The outer cuff 72 and interior material 84 may serve the same contour-conforming function, but also contain items necessary for the operation of the motorized surfboard fin.

Contained within the outer cuff 72 are electronics waterproof protective shells 74 which themselves may contain radio signal receiver 76, switching module 77, battery management module 88 and batteries 75.

The leash cord 5 is attached to the ankle cuff 71 by leash a swivel fitting group 57, which may be anchored in protective shells 74 (as shown in FIG. 10) or in the outer cuff 72, or another component within the ankle cuff 71.

Together, the outer cuff 72 and interior material 84 may wrap completely around protective shell(s) 74, and the outer surfaces of the outer cuff 72 may contact the surfer's leg or ankle and the external environment.

The outer cuff 72 and/or interior material 84 may also be sufficiently flexible to allow the protective shells 74 to articulate with respect to one another, along, for example, axes of articulation 86*a*, where such articulation allows the ankle cuff 71 to be opened, closed and adjusted around the user's ankle. The leash cuff 71 may be held firmly and comfortably in place by a strap 73, which may be preferably a hook and loop strap type.

The outer cuff 72 and/or interior material 84 may be a flexible strap encasing and/or connecting protective shell(s) 74. This strapping material may be sufficiently strong to bind these protective shells together when pulling forces are applied to the surf leash 5. The outer cuff 72 and/or interior material 84 may be for example, nylon webbing or cord, or plastic sheeting, and may be constructed of the same material and/or be a continuous extension of the strap 73.

The outer cuff 72 and/or interior material 84 may be a resiliently compressible material, for example foam rubber, where said material compressibly conforms to the contours of the user's ankle during use and during the application of forces normal to its surfaces, and recovers its initial shape when these forces are removed. By conforming evenly to the user's ankle, such resiliently compressible material avoids the concentration of these forces in several points, such that the user experiences discomfort.

The outer cuff 72 and/or interior material 84 may be waterproof or water resistant to assist in excluding water from electronics and batteries contained within protective shells 74.

The outer cuff 72 and/or interior material 84 may be sufficiently buoyant (lower density than water) and of sufficient total volume to fully or partially offset the negative buoyancy of the batteries or other items necessary for the operation of the motorized surfboard fin. In the event where the leash cuff 71 detaches from the user's ankle while in the water, the leash cuff 71 may therefore not sink.

The interior material 84 may be a self-skinning foam rubber such that the outer cuff 72 may be constructed of the same material.

Electrical conductors are provided to connect the batteries, receivers, control units and the enclosures, and between the enclosures and swivel fitting 40, the conductors may be flexible braided wire which is not shown for purposes of clear illustration.

The electronics protective shells 74 may consist of an exterior hard plastic shell with opening cover, hinges, securing clasps and waterproofing gaskets where said cover may be opened and closed to access the electronics within. Alternatively, the protective shells 74 may consist partially or entirely of a flexible rubber potting compound that encapsulates the electronics modules, wiring harness and batteries, and all electronics and batteries within may not be accessed except for a charging port to recharge the batteries, switch to reset fuse, or battery access and exchange hatch, and so on. The protective shells 74 may be distinct enclosures surrounding the individual electronics modules, or may be comprised of potting of the individual modules together or separately, or may not be used at all.

When the surfer desires the motor to operate and provide additional thrust, he would depress the button switch on the waterproof user-worn trigger 10 (shown in FIG. 14), or installed in another location, depending on the embodiment. The resulting signal, when received by radio signal receiver 76, has the result of closing the circuit within switching module 77, and providing electrical power to the motor 21, optionally via power conditioning module 63.

Because radio transmission frequencies available for consumer devices are entirely attenuated beneath several inches at the water surface, whenever the surfer's hand is paddling sufficiently deep in the water, the signal will be interrupted and absent some additional influence, the drive circuit would open leading to start/stop behavior while paddling. To address this, switching module 77 may include an instantaneous on/delay off function where the circuit can remain closed for some amount of time absent an incoming signal before turning off (for example 1-5 seconds). The switching module 77 may also include a fuse that would cause the circuit to open should some maximum current be exceeded. The switching module 77 may also include a ground fault detection circuit, where should current leak to ground (e.g. the seawater in case of an exposed or broken conductor), the circuit would open and cease leaking current.

Batteries 75 may be provided within the protective shells 74 connected in series or series-parallel to achieve sufficient voltage for the motor. The batteries may be high power density rechargeable type, for example lithium-ion. They could be cylindrical cells (as shown in FIG. 10) or pouch type or prismatic or any combination thereof. An external means of charging the batteries using mains current would be provided with the system, and said battery charging means are not anticipated to be located internal to the ankle cuff.

Figure 12:
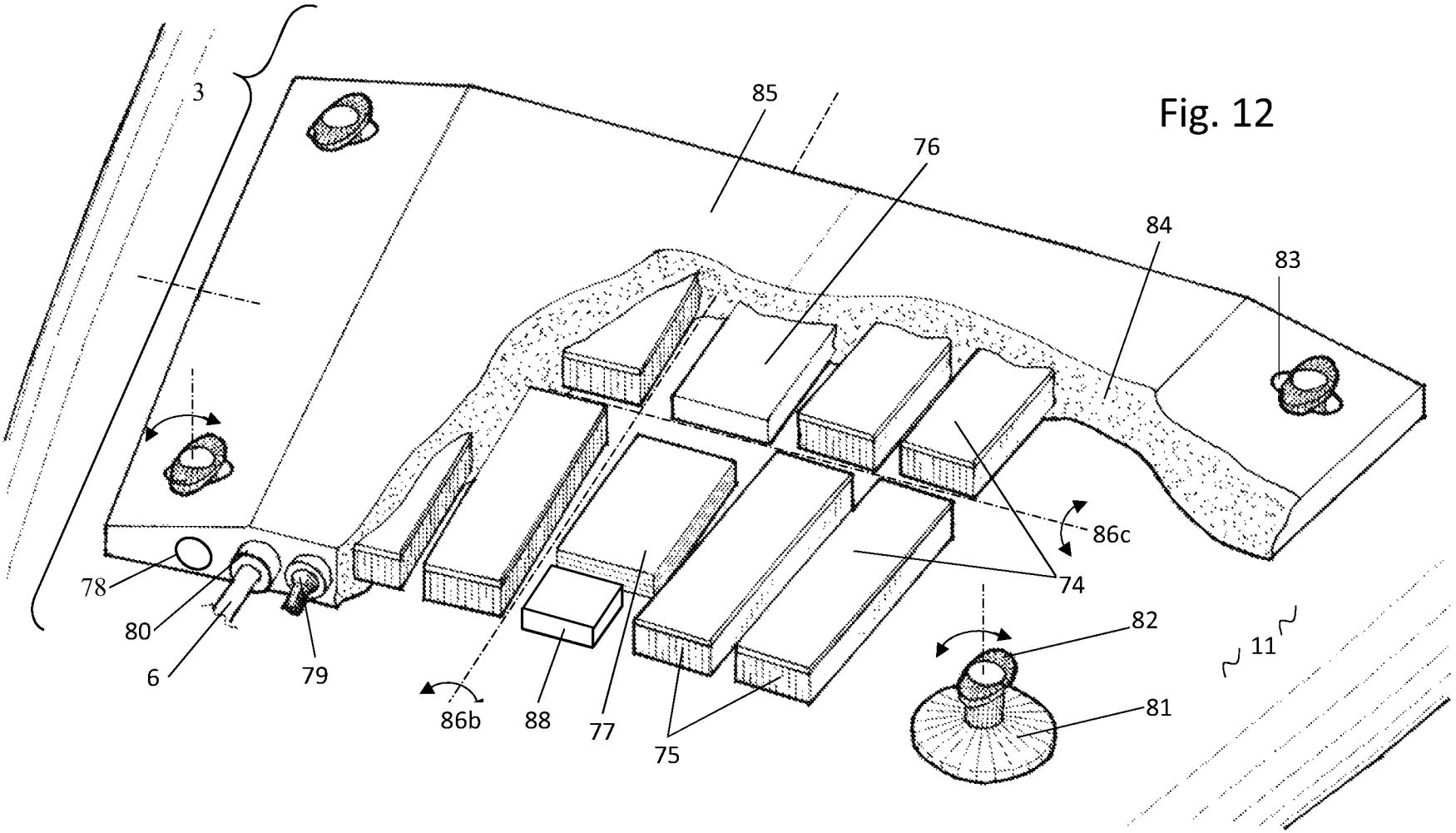
FIG. 12 shows an external power supply, in which the power supply is a detachable traction pad battery pack which conforms to the surface contours of the surfboard.

FIG. 12 includes a view of a charging port for this purpose. A similar port may be located on the ankle cuff. Batteries may be also charged without direct electrical connection, by for example induction re-charging.

Figure 11:
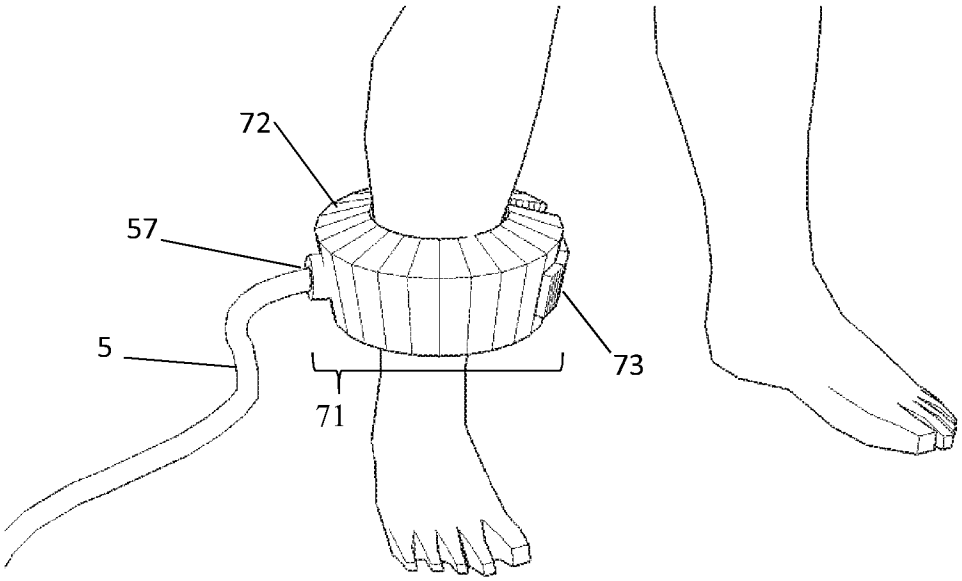
FIG. 11 is a perspective view showing the user-worn power supply which is a leash cuff as worn about an ankle of a user, in which the leash cuff conforms to the contours of the user's ankle.

FIG. 11 is a perspective view showing the ankle cuff 71 as worn by the surfer. The outer cuff 72, strap 73, swivel fitting 57 and leash cord 5 are shown, where other elements introduced in FIG. 10 are interior to outer cuff 72.

FIG. 12 shows an embodiment of the external power supply 3, in which the power supply may be incorporated into a detachable traction pad of the type commonly used to enhance traction between the surfer's feet and the surfboard 11. Axes of articulation such as axis 86*b*, 86*c* allow the power supply 3 to conform to the contours of any shape of board by allowing rigid electronics components to articulate with respect to one another. This articulation may be accomplished by the deformation of interior material 84 or other flexible connection between said components.

Similar to the user-worn power supply in FIG. 10, the electrical components and their protective shells 74, if used, may be encased within a resiliently compressible, waterproof and preferably buoyant material 84, which may itself be protected from the exterior environment by outer skin 85. Material 84 may be a self-skinning foam rubber such that the outer skin 85 may be constructed of the same material.

Interior material 84 and/or outer skin 85 may contain or consist of a variety of elements such that the power supply 3 conforms to the contours of surfboard 11.

The power supply 3 is temporarily attached to the surfboard 11 by temporary board attachments 81 and their associated twist-lock mechanisms 82. Such attachment mechanisms 82 may be rotated through 90 degrees to allow the power supply to be attached and detached from the board attachments 81 via reinforced through-holes 83. Temporary board attachments 81 may be adhered to surfboard 11 with an adhesive that may be applied and removed without damaging the surfboard 11. Twist lock attachments are shown in FIG. 12, however, any type of fastening may be used that achieves the same purpose. Further, no attachment mechanisms such as 81 may be necessary, and the board detachable contour-conforming power supply 3 may be adhered directly to the exterior upper surface of surfboard 11 with an adhesive.

Rather than adhesive mounting, attachments 81 may be adhered with a vacuum pad, in which the lower portion of the attachment 81 is a suction cup, and is attached to the surfboard 11 with a vacuum pad layer. In the case in which attachments 81 are adhered to the surfboard 11 using suction, these attachments being easily detachable themselves, may therefore be permanently installed within the power supply 3, allowing the power supply 3 to be detachable.

Further, the under surface of the power supply 3 may include integrated suction surfaces, in which part or all of the under surface conforms to the contours of the surfboard 11 and a vacuum pad layer is established between the undersurface of the power supply 3 and the upper surface of the surfboard 11.

A board-detachable power supply 3 may optionally be used as a permanent fixture to the surfboard. The batteries 75 are preferably pouch or prismatic type as shown, but may be cylindrical. All description applied to the electronics modules 88, 77, and 76, batteries 75 and protective shells 74 in FIG. 10 is applied to the embodiment of FIG. 12 as well, with additional details as follows.

The electrical port 80 is shown allowing an electrical connection between the power supply and the motorized fin via non-elongating conductor 6. Electrical port 80 or another such port may also be used for charging the batteries from an external battery charger (not shown). Charge/discharge switch 79 is shown that may allow the user to switch the function of the power supply from providing to storing electrical energy.

A charge status indicator 78 is shown that may alert the user to remaining charge left in the battery or issue alerts when the battery is nearly discharged or completely charged. This may be a light, LCD display, audible alert or any combination thereof.

Figure 13:
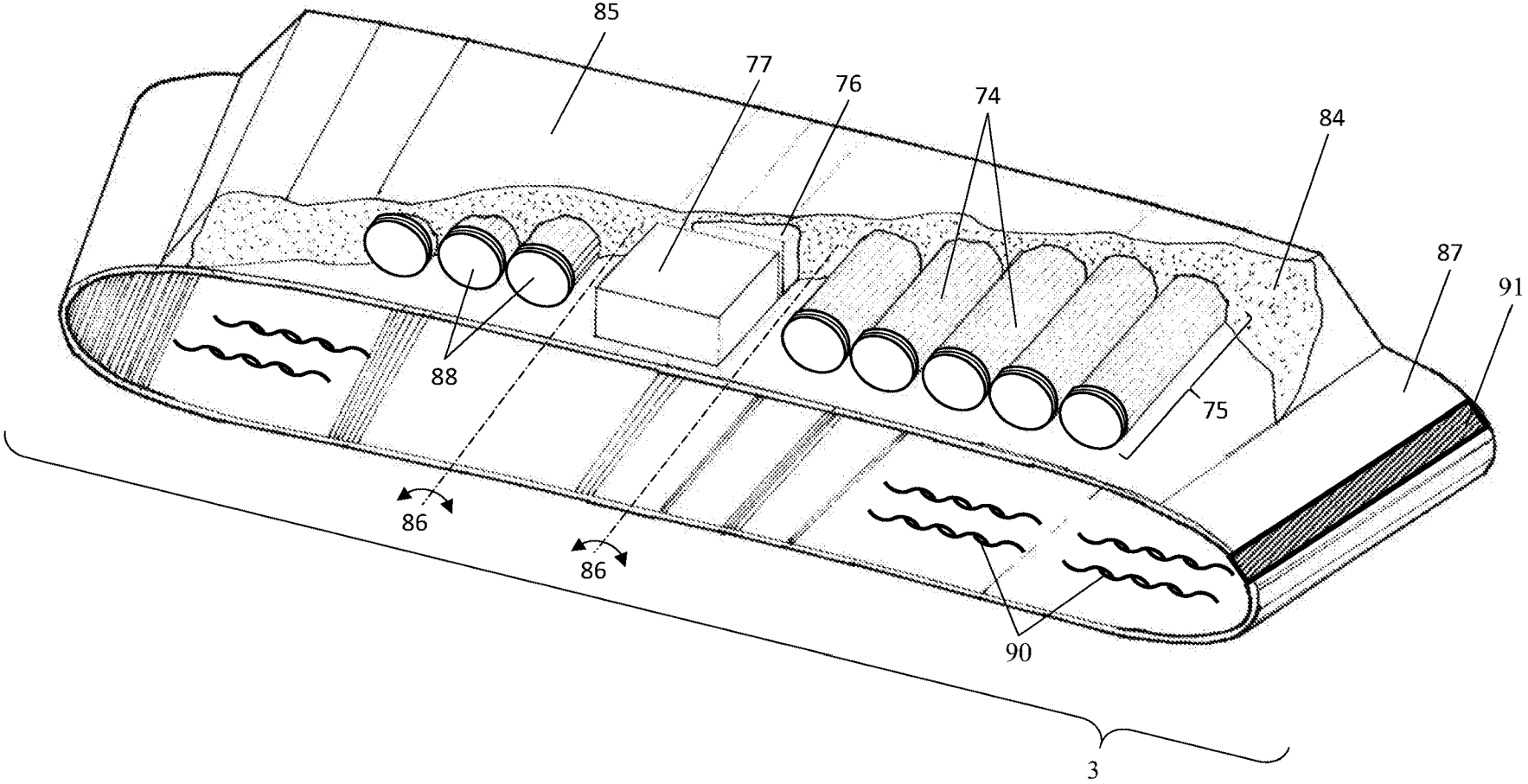
FIG. 13 shows an external conformal and water proof power supply, in which the power supply is a flexible strap that temporarily mounts on a surfboard.

FIG. 13 shows an embodiment of the external power supply 3, in which the power supply may be a detachable, flexible strap that wraps around the surfboard. In this configuration, the board-detachable power supply 3 is temporarily attached to the surfboard 11 by temporary strap 87 that wraps around the board. The strap may be nylon elastic webbing, neoprene, a combination of these or any other suitable durable and waterproof material. The strap may also have a slip-prevention material 90 such as rubber strips on the surfaces facing inward to the surfboard that prevent the strap 87 from slipping against the board exterior surfaces. The strap may include a temporarily adhered overlapping section 91 that allows the easy removal and attachment of the contour-conforming power supply, where such overlapping section consists of hook-and-loop material or temporary adhesive.

As shown and as in FIG. 12, axes of articulation 86*b*, 86*c* allow the rigid electronics modules and batteries to articulate with respect to one another, thereby allowing the power supply 3 to conform to most any shape of board. As in the embodiments in FIG. 10 and FIG. 12, the interior material 84 and/or outer skin 85 may include layers of resiliently compressible material such that power supply 3 may further conform to the contours of surfboard 11. Preferably, the electronics modules may articulate with respect to one another, and the surrounding inner material 84 and outer skin 85 may compressibly conform. However, the electronics modules may be contained within a single monolithic rigid shell and the conformance with exterior surfaces may be accomplished strictly through deformation of the inner material 84 and/or outer skin 85.

As shown the cylindrical batteries 75 include their own protective shells 74 wrapped around said cells and also incorporate their own battery management module 88 in each individual cell, rather than as a separate module. This battery configuration may be used for the strap power supply shown in FIG. 13, the traction pad shown on FIG. 12 or the user-worn power supply in FIGS. 10 and 11, or other contour-conforming, waterproof power supply configurations not presented herein, or may not be used in any such power supply.

The board detachable power supply in FIG. 13 does not show electrical ports, switches, external conductors, or charge indicators as in FIG. 12, however, those may exist in the configuration presented in FIG. 13.

Figure 14:
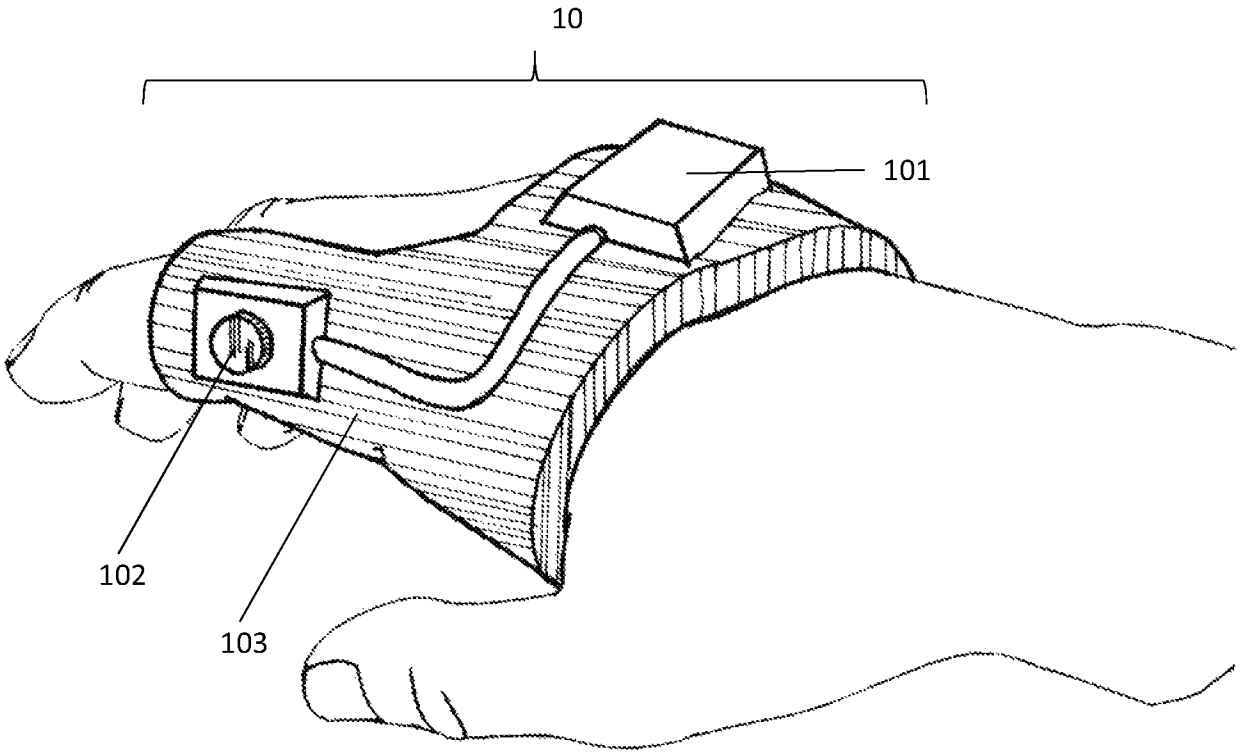
FIG. 14 shows a preferred user-worn trigger.

FIG. 14 shows a waterproof trigger 10 worn on the surfer's hand. Its function is to transmit, preferably, a momentary "on" signal by radio to the radio receiver inside the power supply or fin when desired by the surfer, and to thereby close the necessary circuits and allow electrical current to power the motor within the motorized fin, generating forward thrust from the propeller. The signal is generated by a transmitter module 101 when its button 102 is depressed by the surfer. The trigger remains attached to the surfer's hand by transmitter strap 103, which in the illustrated version is in the form of a sleeve or a glove, which may comprise multiple finger holes or a separate index finger hole and adjacent three-finger hole.

The transmitter module 101 contains elements normally required for signal transmission such as an antenna and signal generator. The transmitter module 101 preferably includes a battery for supplying power to generate the radio signal, in which the battery may be recharged by an internal energy harvesting apparatus (using for example, kinetic energy from motion of the surfer, light, or vibration) or a remote recharging power source like an induction charger or direct electrical connection from a DC power supply.

The trigger 100 may also include other forms of input from the user, for example, a throttle adjustment. In any case, the user input is preferably transmitted to the receiver module via transmitter module 101.

Figure 15:
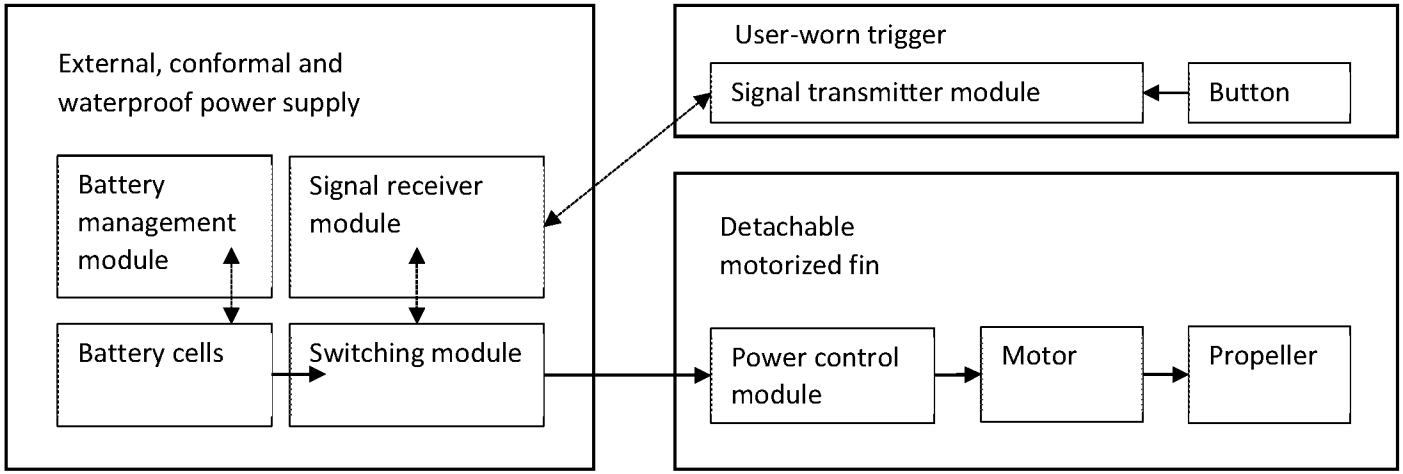
FIG. 15 is a block diagram showing the major functional blocks of the booster system and one embodiment of their physical location in the power supply, transmitter and fin.

FIG. 15 is a block diagram showing the various major system components and their physical location within a preferred version of the inventive systems described above. Thus, in the preferred and illustrated version, the battery management module, battery cells, signal receiver module, and switching module are configured to be external to the detachable motorized fin. The switching module communicates with the power control module portion of the fin, which also includes a motor and propeller as described above. A user-worn trigger includes a button and signal transmitter module, and is preferably separated from the power supply and the fin.

Figure 16:
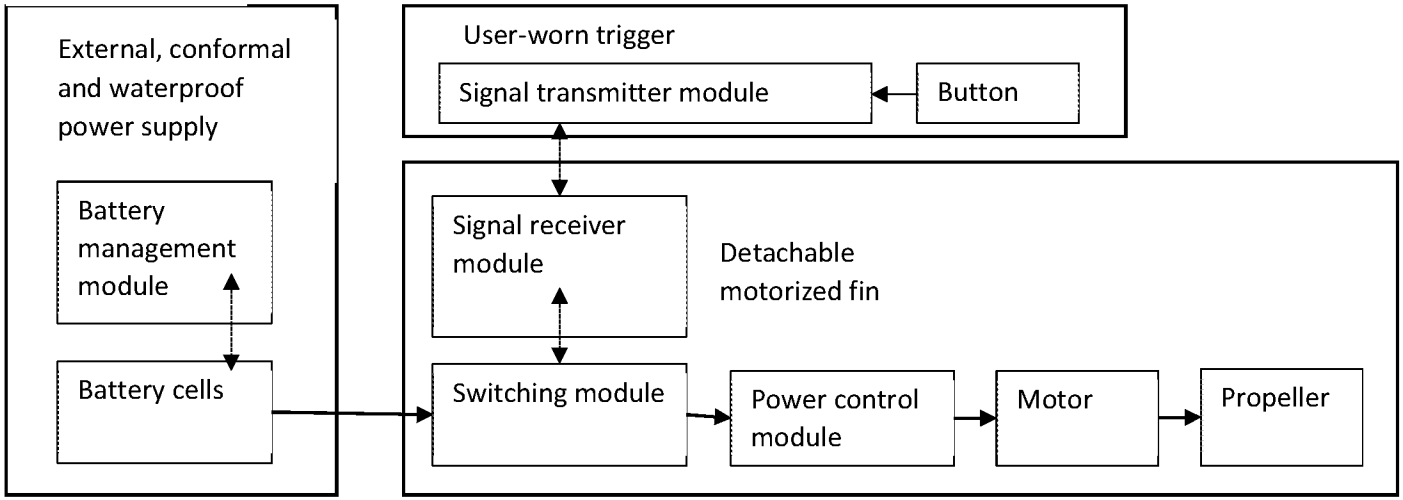
FIG. 16 is a block diagram showing the major functional blocks of the booster system an additional embodiment of their physical location in the power supply, transmitter and fin.

FIG. 16 is a block diagram showing the various components and their physical location within an alternate preferred version of the inventive systems described herein. In this version, the signal receiver module and switching module have been moved from the external contour-conforming unit and integrated into the detachable fin.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A detachable surfboard booster system for attachment to a surfboard, comprising:

a fin having a motor and a propeller, the fin being removably attachable to the surfboard;

a remote trigger;

a power supply electrically connected to the motor under control of the remote trigger, the power supply having a battery the power supply and the remote trigger being separated from and external to the fin and the motor, wherein the power supply is articulable for conforming attachment to each one of a plurality of surfaces, each of the plurality of surfaces having a different shape.

2. The detachable surfboard booster system of claim 1, wherein the power supply further comprises a strap, and wherein the power supply is configured to be worn by a user via attachment of the strap to the user.

3. The detachable surfboard booster system of claim 1, wherein the power supply is configured to be removably attached to the surfboard.

4. The detachable surfboard booster system of claim 3, wherein the surfboard contains an upper surface and a lower surface, the fin being removably attachable to the lower surface and the power supply being removably attachable to the upper surface.

5. The detachable surfboard booster system of claim 1, wherein the propeller comprises a plurality of propeller blades, each of the propeller blades being pivotally moveable between a deployed position and a stowed position.

6. The detachable surfboard booster system of claim 1, wherein the power supply is carried on a cuff, the cuff being configured to be worn about an ankle of a user, and further wherein the power supply is electrically connected to the motor by a leash extending from the cuff.

7. The detachable surfboard booster system of claim 6, wherein the cuff is buoyant in water.

8. The detachable surfboard booster system of claim 6, wherein the leash further comprises at least one swivel fitting.

9. The detachable surfboard booster system of claim 1, wherein the power supply is incorporated into a traction pad, the traction pad being configured for attachment to the surfboard and providing an upwardly-facing traction surface when attached to the surfboard, and further wherein the power supply is electrically connected to the motor by a cable extending from the traction pad.

10. The detachable surfboard booster system of claim 9, wherein the traction pad is buoyant in water.

11. The detachable surfboard booster system of claim 1, further comprising a remote trigger having a transmitter, wherein operation of the transmitter controls the rotation of the propeller.

12. The detachable surfboard booster system of claim 11, wherein the remote trigger further comprises a strap for attachment to a hand of a user.

13. The detachable surfboard booster system of claim 11, further comprising a signal receiver for controlling the operation of the motor, and further wherein the transmitter wirelessly transmits a signal to the signal receiver.

14. The detachable surfboard booster system of claim 11, wherein the signal receiver is attached to the fin.

15. The detachable surfboard booster system of claim 11, wherein the signal receiver is attached to the power supply, and is separated from and external to the fin.

16. The detachable surfboard booster system of claim 5, further comprising a landing post extending from the fin along an axis at the center of rotation of the propeller, the landing post supporting the plurality of propeller blades when they are folded in the stowed position.

17. A detachable surfboard booster system for attachment to a surfboard, comprising:

a combined fin and motor having a propeller powered by the motor, the propeller having a plurality of blades hingedly mounted to a drive shaft and pivotally moveable between a stowed position in which the plurality of blades are pivoted toward one another and an operable deployed position in which the plurality of blades extend radially outward from the drive shaft, the combined fin and motor being removably attachable to a lower surface of the surfboard;

a remote trigger;

a power supply having a battery and a signal receiver, the power supply, in response to a signal received from the remote trigger by the signal receiver, being electrically coupled to the combined fin and motor by a cable extending from the power supply to the combined fin and motor, the power supply including the battery and the signal receiver being separated from and external to the combined fin and the motor;

wherein the power supply is carried on a cuff, the cuff being configured to be worn about an ankle of a user, and further wherein the power supply is electrically connected to the motor by a leash extending from the cuff.

18. The detachable surfboard booster system of claim 17, wherein the remote trigger is separated from the cuff and the combined fin and motor, the remote trigger having a transmitter, wherein operation of the transmitter controls the rotation of the propeller.

19. A detachable surfboard booster system for attachment to a surfboard, comprising:

a fin having a motor and a propeller, the fin being removably attachable to the surfboard;

a power supply electrically connected to the motor, the power supply being separated from and external to the fin and the motor, the power supply being carried on a cuff, the cuff being configured to be worn about an ankle of a user, and further wherein the power supply is electrically connected to the motor by a leash extending from the cuff.

* * * * *